US009962710B2

(12) United States Patent
Suderman

(10) Patent No.: US 9,962,710 B2
(45) Date of Patent: May 8, 2018

(54) MAGNETIC ROLL

(71) Applicant: Bunting Magnetics Co., Newton, KS (US)

(72) Inventor: Donald A. Suderman, Newton, KS (US)

(73) Assignee: Bunting Magnetics Co., Newton, KS (US)

( * ) Notice: Subject to any disclaimer, the term of this patent is extended or adjusted under 35 U.S.C. 154(b) by 0 days. days.

(21) Appl. No.: 15/204,213

(22) Filed: Jul. 7, 2016

(65) Prior Publication Data

US 2016/0310962 A1 Oct. 27, 2016

(51) Int. Cl.

| | |
|---|---|
| ***B03C 1/10*** | (2006.01) |
| ***B03C 1/18*** | (2006.01) |
| ***B03C 1/033*** | (2006.01) |
| ***B03C 1/034*** | (2006.01) |

(52) U.S. Cl.
CPC ..... *B03C 1/18* (2013.01); *B03C 1/034* (2013.01); *B03C 1/0332* (2013.01)

(58) Field of Classification Search
CPC .... B03C 1/10; B03C 1/12; B03C 1/16; B03C 1/18; B03C 1/247
USPC ..... 209/219
See application file for complete search history.

(56) References Cited

U.S. PATENT DOCUMENTS 2,272,719 A * 2/1942 Maynard ..... B03C 1/12 209/219
2,992,733 A 7/1961 Buus et al.
3,389,794 A 6/1968 Miyata
3,394,807 A 7/1968 Fritz et al.
3,455,276 A * 7/1969 Anderson ..... G03G 9/083 209/219
3,721,189 A 3/1973 Bray
3,879,737 A * 4/1975 Lunde ..... G03G 15/0914 347/55
4,047,609 A 9/1977 Nazuka
4,068,622 A 1/1978 Vola
4,234,076 A 11/1980 Spodig
4,359,382 A * 11/1982 Morgan ..... B03C 1/14 209/223.2
4,626,749 A 12/1986 Asakawa
4,676,161 A 6/1987 Peekna
4,781,821 A * 11/1988 Salmi ..... B03C 1/14 209/214

(Continued)

FOREIGN PATENT DOCUMENTS

| | | |
|---|---|---|
| CN | 201189490 | 11/2007 |
| EP | 2889511 | 1/2015 |

(Continued)

*Primary Examiner* — Joseph C Rodriguez
(74) *Attorney, Agent, or Firm* — Kenneth H. Jack; Davis & Jack, L.L.C.

(57) ABSTRACT

A magnetic roll having a rotation axis, the magnetic roll including an axial series of segmented rings, each of the rings' segments incorporating a permanent having an outer end, an inner end, an axial end, an oppositely axial end, a circumferential end, a counter-circumferential end, a north pole positioned at the inner or outer end, and a south pole positioned oppositely from the north pole; a bonding matrix rigidly interconnecting the rings; and a magnetic armature operatively spanning between the permanent magnets' inner ends.

13 Claims, 7 Drawing Sheets

(56) References Cited

U.S. PATENT DOCUMENTS 4,869,811 A * 9/1989 Wolanski ..... B03C 1/12 209/212
5,014,028 A 5/1991 Leupold
5,019,796 A * 5/1991 Lee ..... G03G 15/0921 335/302
5,108,587 A * 4/1992 Walker ..... B03C 1/247 209/212
5,207,330 A * 5/1993 Siesco, Jr. ..... B03C 1/247 209/212
5,334,892 A 8/1994 Chitayat
5,349,258 A 9/1994 Leupold et al.
5,506,558 A * 4/1996 Laube ..... F16C 32/0431 310/90.5
5,751,083 A 5/1998 Tamura et al.
5,913,401 A 6/1999 Tamura et al.
5,952,744 A 9/1999 Chitayat
6,208,047 B1 3/2001 Agematsu et al.
6,330,946 B1 * 12/2001 Allen ..... B03C 1/12 209/219
6,338,903 B1 * 1/2002 Takigawa ..... B03C 1/12 209/217
6,343,419 B1 * 2/2002 Litman ..... G03G 15/0921 29/895.21
6,454,686 B1 * 9/2002 McEachern ..... B26D 7/2614 335/302
6,798,087 B1 9/2004 Swift
7,296,675 B1 11/2007 Shuttleworth et al.
7,393,413 B2 7/2008 Kido et al.
8,054,291 B2 * 11/2011 Takatsuka ..... G06F 3/0338 178/18.07
8,109,383 B1 * 2/2012 Suderman ..... B65G 15/58 198/690.2
8,963,358 B2 2/2015 Phillips
9,010,538 B2 * 4/2015 Smolkin ..... B03C 1/18 209/219
9,375,727 B2 * 6/2016 Molteni ..... B03C 1/14
2006/0091748 A1 5/2006 Yoda et al.
2013/0264248 A1 10/2013 Smolkin et al.
2014/0012070 A1 1/2014 Nagl et al.
2015/0170815 A1 6/2015 Kertsopoulos
2017/0203303 A1 * 7/2017 Nishizawa ..... B03C 1/14
2017/0232449 A1 * 8/2017 Donald ..... B03C 1/30

FOREIGN PATENT DOCUMENTS

GB 768431 2/1957
WO WO2012098395 7/2012

* cited by examiner

MAGNETIC ROLL

FIELD OF THE INVENTION

This invention relates to roll or roller configured magnets which are utilized in conveyor belt actuated magnetic separators.

BACKGROUND OF THE INVENTION

Continuous loop belt conveyors having an output end roller are known to be adapted for separation of ferrous materials conveyed by the conveyor. Such adaptation magnetizes the cylindrical outer surface of the conveyor's output end roller.

As a beneficial result of such conveyor output roller, magnetization, non-ferrous items such as plastics which are forwardly carried along the conveyor's upper flight may dispense at the conveyor's conventional output, while ferrous items, such as intermixed scrap nails and screws may separately dispense from the conveyor's lower flight upon rearwardly exiting the roller's magnetic field.

Where materials to be separated by such conveyor belt magnetic separators are magnetically permeable or have a high level of magnetic susceptibility, conventional and known configurations of permanent magnets within and upon the conveyor's output roller may acceptably separate ferrous items from other conveyed materials. However, in some circumstances the material conveyed by a magnetic separating conveyor becomes piled to a depth which raises ferrous materials away from the magnetic roller, and in other circumstances, ferrous materials with low magnetic susceptibility, such as scrap stainless steel, are carried upon the conveyor. In such circumstances, the conventional and known magnetic roll configurations often unacceptably attract and separate the ferrous materials.

The instant invention magnetic roll solves such magnetic strength related problems by specially configuring a tubular matrix of permanent magnets to present a specialized array of magnetic north and south poles at the roll's outer surface and by magnetically armaturing an inverse inward array of magnetic poles.

BRIEF SUMMARY OF THE INVENTION

A first and primary structural component of the instant inventive magnetic roll comprises an axial series of segmented rings. Each of the segmented ring components preferably has inside and outside diameter dimensions identical to those of each of the other segmented rings. Axial stacking of the segmented rings in series preferably aligns them with each other to approximate the shape of a right tube or right hollow cylinder geometric solid.

The segmenting of the roll's ring components is preferably circumferential so that seams formed at abutting circumferential and counter-circumferential faces or ends of the segments lie within planes which intersect at the roll's rotation axis. In the preferred embodiment, the number of segments of each ring is equal to each other. In order to present at the radially outer surfaces of the rings continuous circumferential series alternating north and south poles, the number of each rings' segments is also preferably even. Also, each ring segment is preferably identical to each other ring segment, each having a radially inner end, a radially outer end, an axial end, an oppositely axial end, a circumferential end, and a counter-circumferential end. In the preferred embodiment, each of the rings' segments comprises a permanent magnet, preferably a neodymium iron boron magnet, a samarium cobalt magnet, an alnico or aluminum nickel cobalt magnet, or an iron oxide or ferrite ceramic magnet.

In the preferred embodiment, each of the permanent magnet ring segments of the roll either has its north pole situated at its radially outer end, or has its south pole situated at its radially outer end, each such magnet segment having its opposing pole (south or north pole as the case may be) situated at its radially inner end. The radially outer ends of the permanent magnet ring segments preferably comprise arcuately curved surfaces which cumulatively form the roll's cylindrical outer surface.

Further structural components of the instant inventive magnetic roll comprise a bonding matrix which rigidly interconnects the segmented rings in their axially stacked series configuration, and further rigidly interconnects the ring's segments in their circumferentially arrayed ring forming series. Preferably, the bonding matrix comprises an epoxy or cyanoacryalate based adhesive.

Further structural components of the instant inventive magnetic roll preferably comprise a tube configured magnetic armature which radially inwardly underlies and spans between the north and south poles presented at the inner ends of the magnetic ring segments. In the preferred embodiment, the magnetic armature comprises iron or mild steel, such armature being inwardly supported by an axle core.

In a preferred embodiment of the instant magnetic roll, the rings' magnetic segments are arranged to present at the radially outer surface of the roll both alternating circumferential series of north and south poles and alternating and continuous axial series of north and south poles. The segmented magnetic rings are preferably circumferentially and counter-circumferentially offset with respect to each other for, in addition to their formations of axially alternating series of north and south poles, presenting circumferentially adjacent axially continuous north pole series and axially continuous south pole series.

The cumulative effects of the invention's underlying magnetic armature, alternating circumferential pole series, and axial pole series advantageously enhance magnetic flux density and magnetic attractive strength over the entirety of the outer surface of the roll. Such magnetic strength enhancements allow the magnetic roll to be effectively utilized for magnetic separation of low magnetic susceptibility stainless steel scrap metal.

Accordingly, objects of the instant invention include the provision of a magnetic roll which incorporates structures, as described above, and which arranges those structures in relation to each other in manners described above for the performance of the beneficial functions described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
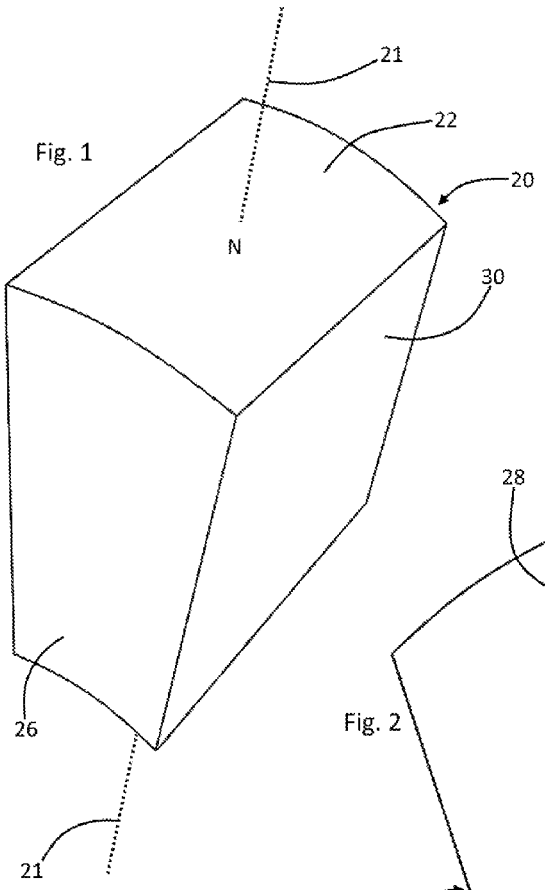
FIG. 1 is a perspective view of one of the permanent magnet components of the instant inventive magnetic roll.
Figure 2:
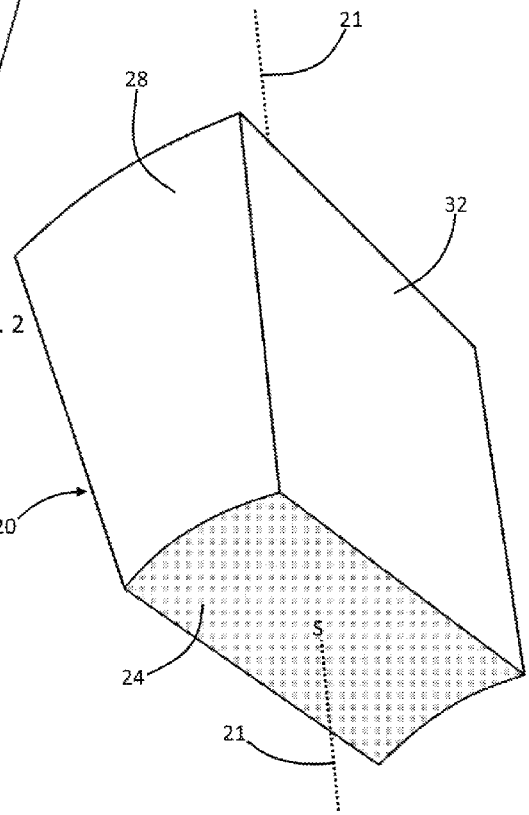
FIG. 2 is an alternative perspective view of the magnet of FIG. 1.
Figure 6:
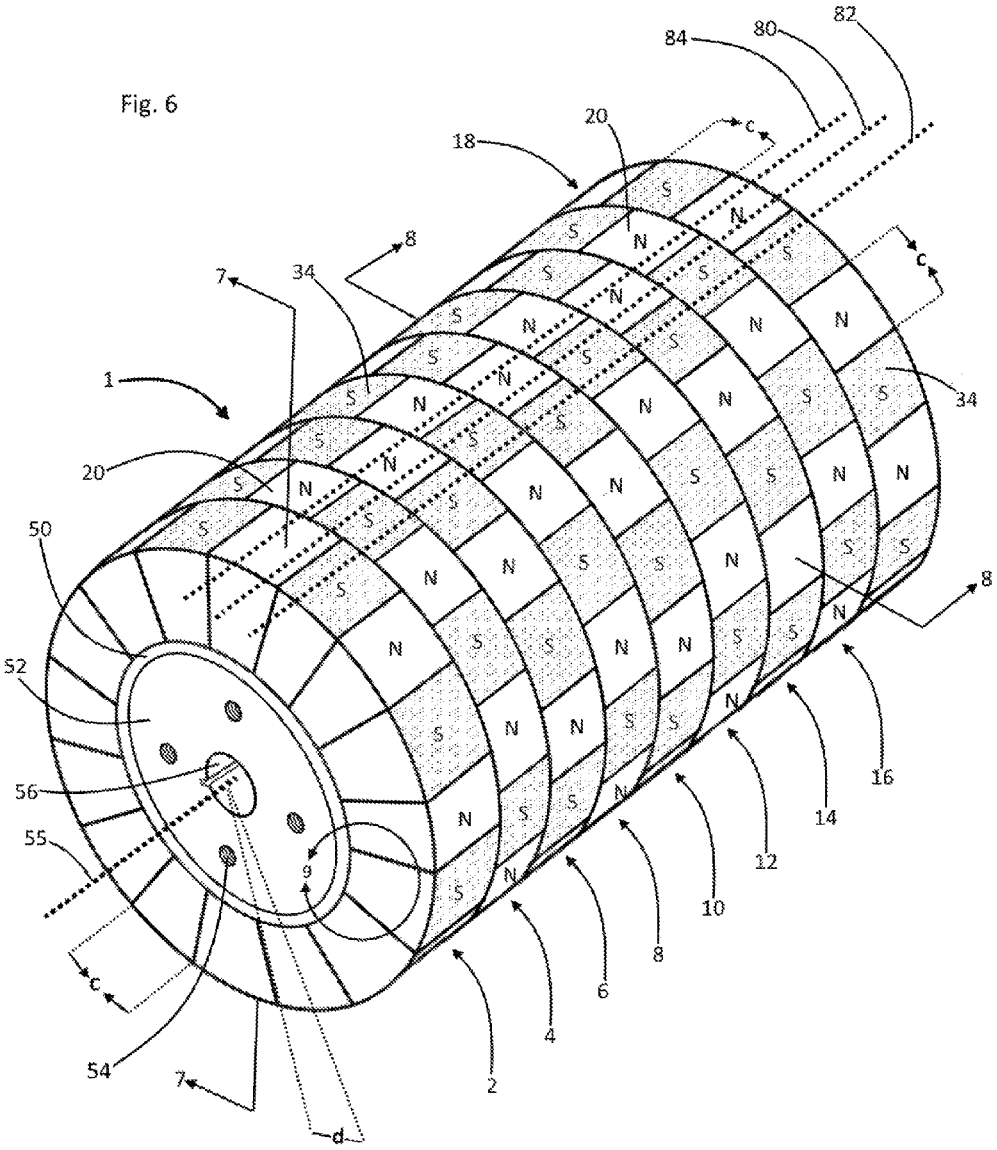
FIG. 6 is a perspective view of a preferred embodiment of the instant inventive magnetic roll.

Referring now to the drawings and in particular simultaneously to Drawing FIGS. 1, 2, and 6, a preferred embodiment of the instant inventive magnetic roll is referred to generally by Reference Arrow 1. A permanent magnet segment component of the roll 1 is referred to generally by Reference Arrows 20, such magnet 20 having a convexly arcuately curved radially outer face or end 22, and a concavely arcuately curved radially inner face or end 24. The magnet 20 has an axial end 26, an oppositely axial end 28, a circumferential end 30, and a counter-circumferential end 32. The magnetic characteristics of the magnet 20 include a radially extending polar axis 21 whose north direction is toward the magnet's radially outer end 22, the south direction being toward the radially inner end 24.

Figure 3:
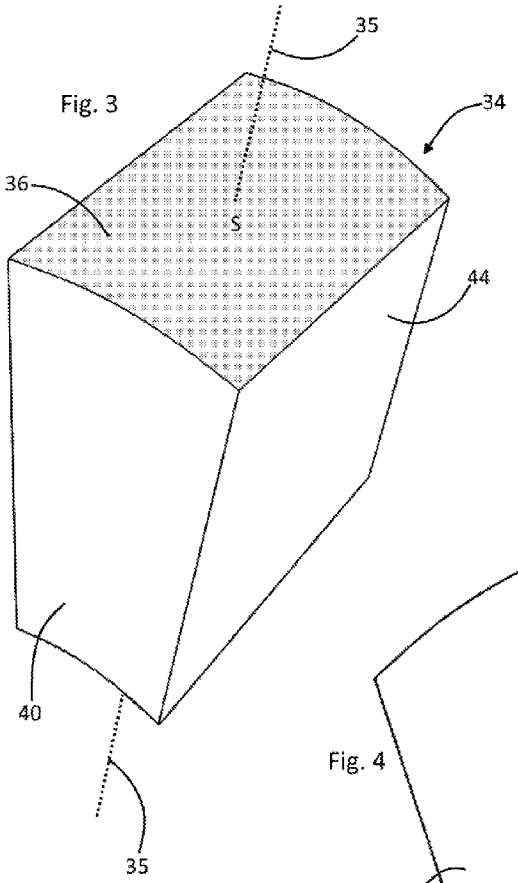
FIG. 3 is a perspective view of another permanent magnet component of the inventive magnetic roll.
Figure 4:
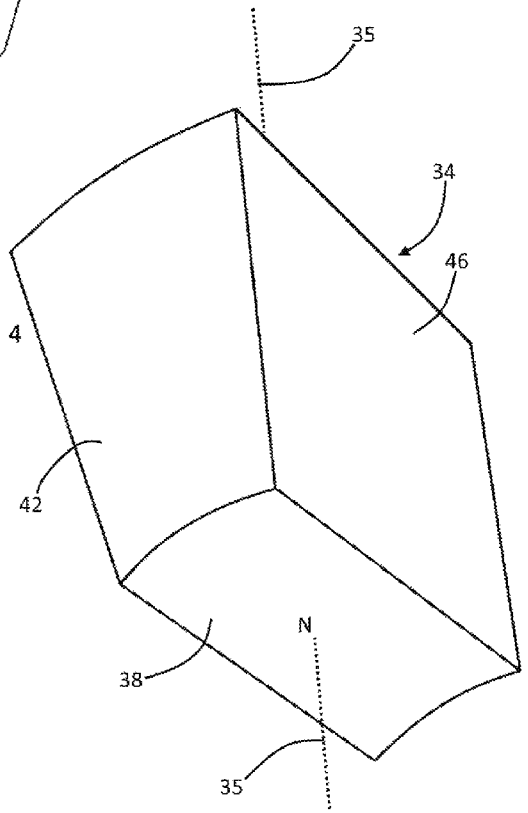
FIG. 4 is an alternative perspective view of the magnet of FIG. 3.

Referring simultaneously to FIGS. 3 and 4, a similarly geometrically configured permanent magnet having an opposite magnetic characteristic is referred to generally by Reference Arrows 34. The magnets 34 are preferably configured substantially identically with magnets 20, each magnet 34 having a radially outer end 36, a radially inner end 38, an axial end 40, an oppositely axial end 42, a circumferential end 44, and a counter-circumferential end 46. Similarly with the magnetic polarity line 21 of magnet 20, magnet 34 has a radially extending line of magnetic polarity 35. However, in contrast with magnet 20, magnet 34 situates its south pole at the magnet's radially outer end 36 with its opposing north pole being positioned at its radially inner end 38.

Figure 5:
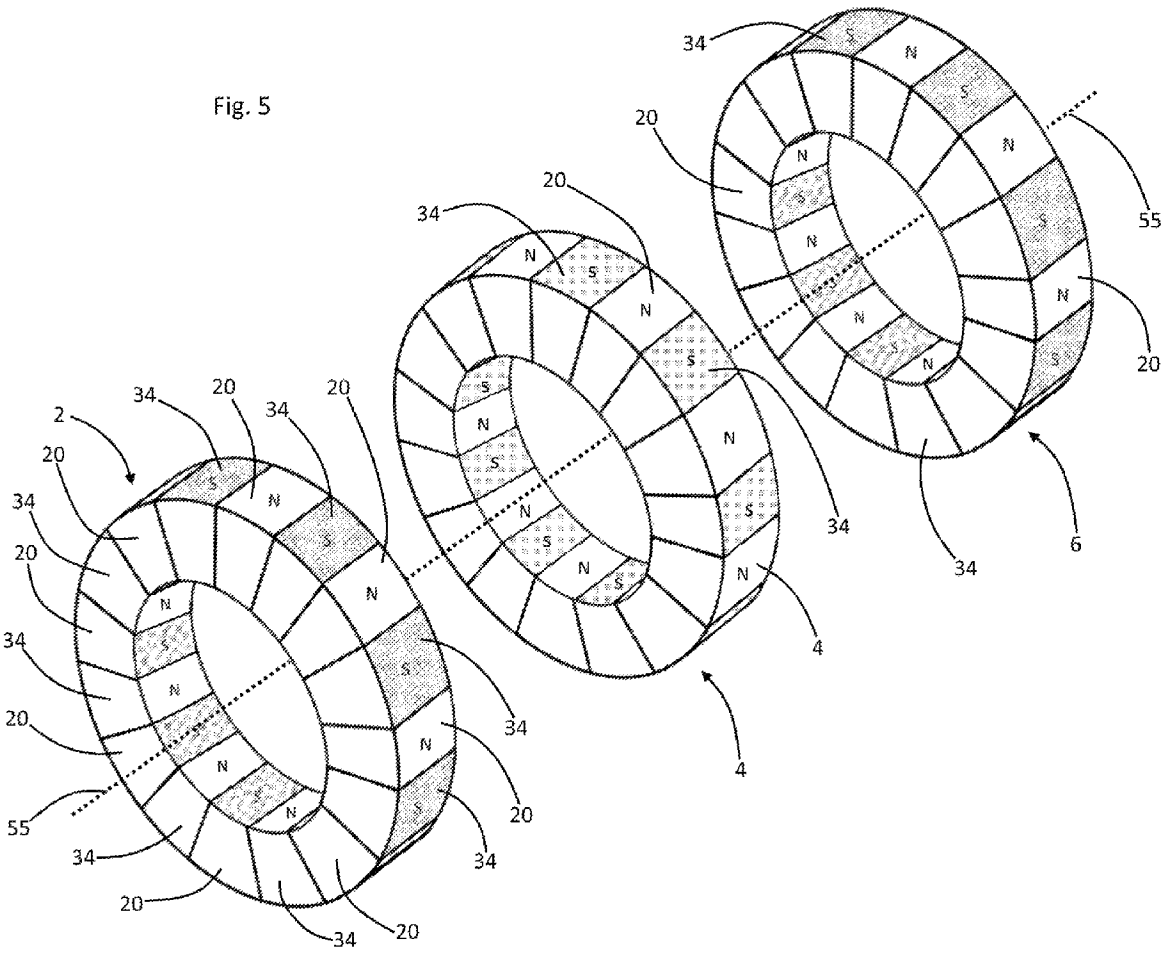
FIG. 5 depicts in an exploded view of three of the segmented magnetic ring components of the instant inventive magnetic roll.

Referring simultaneously to FIGS. 1-5, pluralities of substantially identical renditions of the permanent magnets 20 and 34 are preferably provided. As shown in the example of FIG. 5, paired groups of eight of such magnets 20 and 34 are provided, such paired groups being arranged to form a plurality of magnetic rings which is represented by rings 2, 4, and 6.

Figure 9:
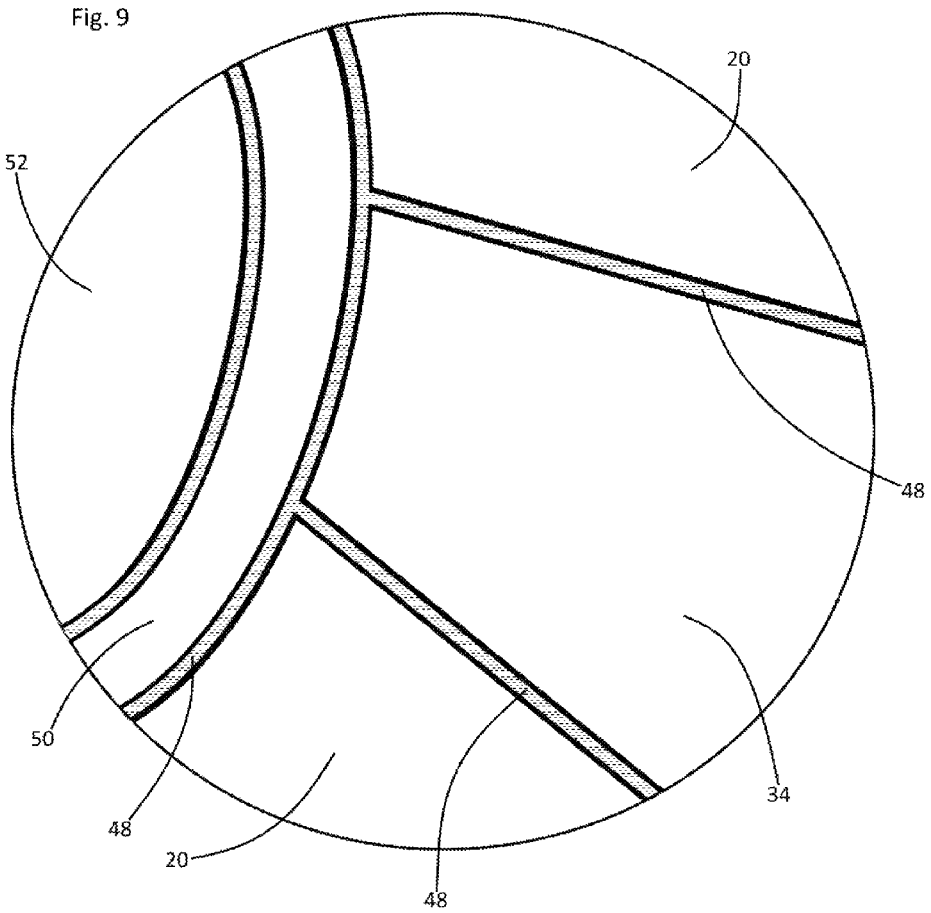
FIG. 9 is a magnified view of a portion of the structure of FIG. 6, as indicated in FIG. 6.

Magnetic repulsive tendencies of the magnets 20 and 34 to disarrange themselves from their depicted circular configurations are preferably resisted by, referring further to FIGS. 6 and 9, adhesive bonds 48, such bonds preferably being composed of hardened epoxy resin or a cyanoacryalate based adhesive.

In a preferred configuration of the magnetic rings 2, 4, and 6, each radially outer north pole (i.e., the north poles of the magnets 20) is preferably circumferentially adjacent to a radially outer south pole (i.e., the south poles of magnets 34). Correspondingly, each radially inner north pole is similarly circumferentially adjacent a radially inner south pole. Accordingly, the magnetic rings 2, 4, and 6 advantageously form circumferentially alternating series of north and south poles at both their radially outer and radially inner surfaces.

The total number of permanent magnet segments of each of the rings 2, 4, and 6 is preferably even with half of the magnets having a radially outer north pole as indicated by FIG. 1 and half of the magnets having a radially outer south pole as indicated by FIG. 3. The preferred provision of even numbers of magnets within each of the rings assures that the rings' alternating north and south pole series are circumferentially continuous. The magnetic rings 2, 4, and 6 are preferably configured substantially identically with each other, and referring further to FIG. 6, additional magnetic rings 8,10,12,14,16,18 may be provided, such additional rings also being identically configured.

Referring simultaneously to FIGS. 5 and 6, the depicted exemplary axial series of nine magnetic rings 2-18 is preferably stacked in an abutting and axially aligned series to form or approximate a right tube or right hollow cylinder geometric solid. Normal plane seams (i.e., seams lying within planes to which the rotation axis 55 is normal or perpendicular) which are formed at the abutting axial and oppositely axial faces of the rings 2-18 are preferably bonded and held in place by adhesive bonds similar to epoxy or cyanoacryalate bonds 48 appearing in FIG. 9.

Referring to FIG. 6, each ring among the magnetic rings 2-18 is preferably circumferentially or counter-circumferentially offset with respect to at least one adjacent ring. For examples, the axial-most ring 2 is circumferentially offset with respect to ring 4, and the oppositely axial-most ring 18 is counter-circumferentially offset with respect to ring 16. The medially positioned rings of the roll 1 (i.e., rings 4-16), each of which is adjacent to and is interstitially positioned between a pair of the rings, are preferably both circumferentially and counter-circumferentially offset with respect to their adjacent rings.

The angular magnitude of each ring's relatively adjacent circumferential and/or counter-circumferential offset preferably equals a rotational displacement angle of d° where d equals 180 divided by the number of segments in each ring. For the exemplary sixteen segment ring depicted in FIGS. 5, 6, and 8, the displacement angle d is 11.25°. Each of the radially outer ends 32 and 36 of the magnet segments 20 and 34 has a circumferential dimension "c", and each circumferential offset, or 11.25° angular displacement d, circumferentially or counter-circumferentially moves the magnets' radially outer ends a distance with respect to each other equal to ½c. A preferred angular displacement or offset equals d or ½c, as defined above. Notwithstanding, the angular displacement or circumferential offset may suitably be as little as ½d or ¼c.

Figure 7:
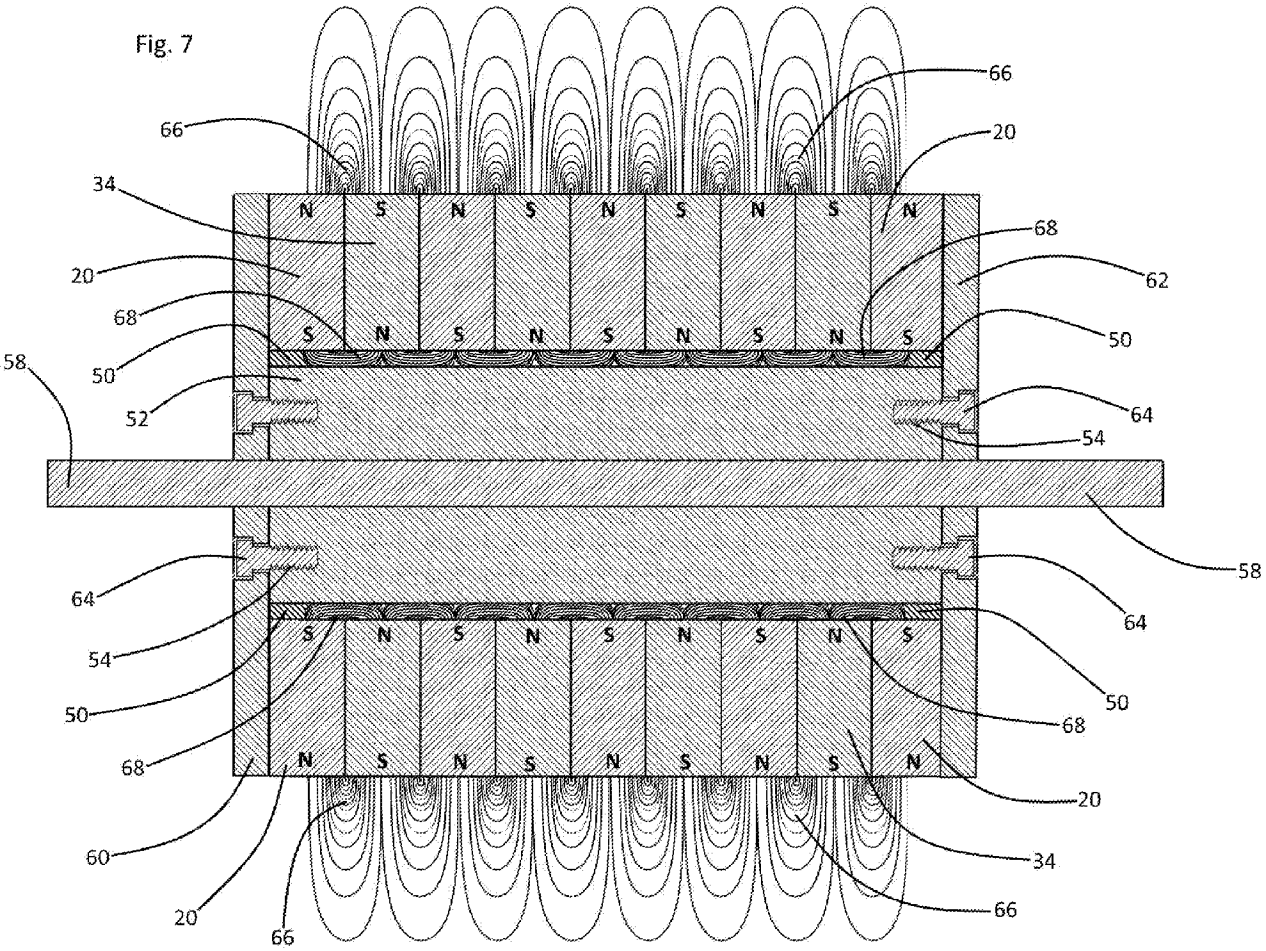
FIG. 7 is a sectional view as indicated in FIG. 6.
Figure 8:
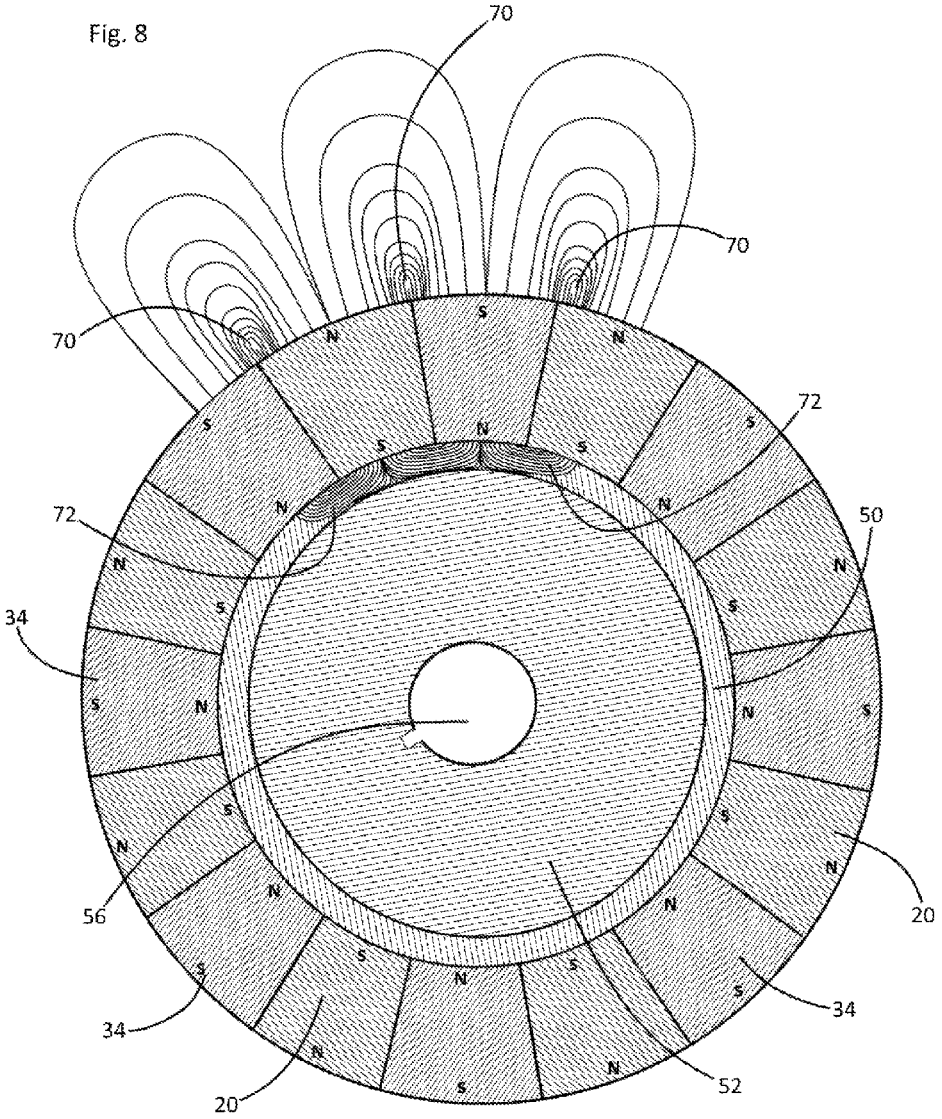
FIG. 8 is an alternative sectional view as indicated in FIG. 6.

Referring to FIGS. 6-8, the utility of the preferred d or ½c ring offsets is reflected in the response of the roll's magnetic flux densities 66 and 70 to a hypothetical freeing of the magnetic rings 2-18 for independent rotations about axis 55. Upon such free ring rotation, the radially outer north and south poles 22 and 36 of the magnets 20 and 34 are magnetically rotated and counter-rotated to assume a north/south checkerboard pattern (not depicted within views) about the surface of the roll 1. Upon such free rotations of the rings 2-18 toward such checkerboard north/south pole pattern, the sum of the magnetic roll's magnetically induced torque and counter-torque forces or rotational and counter-rotational moments imposed upon the rings 2-18 about axis 55 approaches zero. Such hypothetical checkerboard pattern represents a rotational stable equilibrium orientation of the rings 2-18 at which the cumulative magnitude of the magnetically induced torque and counter-torque forces is at a minimum. Accordingly, at such stable checkerboard pattern, minimal torque and counter-torque forces mechanically applied to the rings 2-18 will begin to move the rings toward the preferred d or ½C circumferential offsets. At the hypothetical checkerboard pattern, magnetic flux density 66,70 at the radially outer surface of the roll 1 is at a relative minimum.

As the roll's ring offsets are rotatably moved from the above described hypothetical stable checkerboard pattern (i.e., the zero offset position) toward offsets equal to ½d or ¼c, the mechanical torque and counter-torque needed to be applied to the rings 2-18 progressively increases to a maximum. Upon reaching the ½d or ¼c offset, the sum of the magnetically induced torque and counter-torque moments correspondingly reaches a maximum. Upon reaching the ½d or ¼c rotational offset configuration, the cumulative magnitude of the roll's magnetically induced torque and counter-torque moments is significantly higher than that experienced at the stable checkerboard configuration, and correspondingly, the magnetic flux density 66,70 at such configuration is significantly greater than the minimum of the checkerboard pattern. However, the flux density at the ½d or ¼c position is not maximized.

Levels of mechanically applied torque and counter-torque forces needed to further rotatably move the rings 2-18 from the above described ½d or ¼c offset positions to the orientations depicted in FIG. 6 (at which the rings 2-18 are offset and counter-offset with respect to each other by the angle d or by the circumferential distance ½c) progressively lessens to zero. Accordingly, the d or ½c offset configuration of FIG. 6 represents an unstable rotational equilibrium position. While the rings 2-18 are easily mechanically held at their d or ½c rotational offset positions, the cumulative magnitude of roll's magnetically induced torque and counter-torque moments is maximized. Thus, the flux density 66,70 drawn in FIGS. 7 and 8 represents an advantageous maximization of magnetic field strength produced at the surface of the roll and achieved through maintenance of a minimum level of mechanically applied torque and counter-torque forces.

The inventive roll 1 may be most easily assembled at the above described hypothetical checkerboard pattern. However, such configuration is relatively undesirable because such configuration minimizes the roll's outer surface magnetic flux density. A second-most easily assembled configuration of the roll 1 is the unstable equilibrium d or ½c offset configuration of FIG. 6. Such depicted configuration is preferred because it constitutes a zero net magnetic torque position and because the flux density 66,70 at such position is maximized.

Aside from the preferred d or ½c offset configuration, ring offsets between ½d or ¼c and d or ½c are viewed as being more desirable and more beneficial than offsets between zero and ½d or ¼c.

Referring further to FIG. 9, applications of adhesive bonds 48 at the normal plane seams between rings 2-18 advantageously secure the rings at their depicted maximized magnetic flux density rotational positions.

Upon rotationally and counter-rotationally positioning the rings 2-18 at their preferred d angle or ½c displaced positions, both alternating and continuous axially extending north and south series of outer surface poles are advantageously formed. Magnets aligned along orientation lines exemplified by line 80 (also represented by the sectional view of FIG. 7) are representative of such alternating axial series of north and south poles, while magnets aligned along orientation lines exemplified by lines 82 and 84 are respectively representative of continuous axial series of south poles and continuous axial series of north poles. The instant inventive roll's preferred alternating circumferential series of north and south poles, in combination with its continuous axial series of north poles, its continuous axial series of south poles, and its alternating axial series of north and south poles advantageously serves to enhance magnetic flux densities 66 and 70, and to enhance the overall magnetic strength of the roll 1.

Referring simultaneously to FIGS. 6-9, the magnetic flux density 66,70 generated by the roll 1 is preferably further enhanced by magnetically armaturing the north and south poles presented at the radially inner ends of the permanent magnets 20 and 34. While the magnetic armature components of the instant inventive roll 1 may suitably comprise variously configured magnetic "bridges" which span between and interconnect the magnets' radially inner north and south poles, the preferred magnetic armature of the instant invention comprises an iron or mild steel tube 50 whose cylindrical outer surface immediately underlies and provides base support to the magnets 20 and 34. Alternatively, the armature element may comprise a solid steel core.

As indicated in FIGS. 7 and 8, the iron or mild steel tubular armature 50 magnetically interconnects the permanent magnets' inner end north and south poles, effectively allowing circumferential and axial pairs of the magnets 20 and 34 to perform in the manner of horseshoe magnets whose arms extend radially outwardly. Axial and circumferential magnetic force lines 68 and 72 within the solid metal wall of the armature 50 are representative of such advantageous magnetic connecting effect.

A roller axle core 52 which radially underlies the armaturing tube 50 is preferably provided, such axle core receiving a rotation axle 58. Roller end plates 60 and 62 may be mounted to the axial and oppositely axial ends of the roller 1 by means of bolts 64 which extend through the plates 60 and 62, and threadedly mount within sockets 54.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope at least commensurate with the appended claims.

The invention hereby claimed is:

1. A magnetic roll having a rotation axis, the magnetic roll comprising:

(a) an axial series of segmented rings, each of said rings' segments comprising a permanent magnet having an outer end, an inner end, an axial end, an oppositely axial end, a circumferential end, a counter-circumferential end, a north pole positioned at the inner or outer end, and a south pole positioned oppositely from the north pole;

(b) a bonding matrix rigidly interconnecting the rings and segments; and (c) a magnetic armature operatively spanning between the permanent magnets' inner ends; wherein a first plurality of magnets among the segmented rings' permanent magnets has outer end north poles having axial and oppositely axial ends, wherein a second plurality of the magnets among the segmented rings' permanent magnets has outer end south poles having axial and oppositely axial ends, wherein each outer end north pole is circumferentially adjacent an outer end south pole; and wherein the axial end of said each outer end north pole is adjacent the oppositely axial end of one of the outer end south poles.

2. The magnetic roll of claim 1 wherein said each outer end north pole is axially adjacent another outer end north pole.

3. The magnetic roll of claim 1 wherein the outer ends of the permanent magnets have circumferential lengths substantially equal to each other.

4. The magnetic roll of claim 3 wherein each segmented ring is circumferentially or counter-circumferentially displaced with respect to an adjacent segmented ring.

5. The magnetic roll of claim 4 wherein the segmented rings' circumferential or counter-circumferential displacements are substantially equal to each other.

6. A magnetic roll having a rotation axis, the magnetic roll comprising:

(a) an axial series of segmented rings, each of said rings' segments comprising a permanent magnet having an outer end, an inner end, an axial end, an oppositely axial end, a circumferential end, a counter-circumferential end, a north pole positioned at the inner or outer end, and a south pole positioned oppositely from the north pole; and (b) a bonding matrix rigidly interconnecting the rings and segments; and (c) a magnetic armature operatively spanning between the permanent magnets' inner ends, wherein a first plurality of magnets among the segmented rings' permanent magnets has outer end north poles, wherein a second plurality of the magnets among the segmented rings' permanent magnets has outer end south poles, wherein each outer end north pole is circumferentially adjacent an outer end south pole, wherein said each outer end north pole is axially adjacent another outer end south pole, wherein the outer ends of the permanent magnets have circumferential lengths substantially equal to each other, wherein each segmented ring is circumferentially or counter-circumferentially displaced with respect to an adjacent segmented ring, wherein the segmented rings' circumferential or counter-circumferential displacements are substantially equal to each other, wherein each ring among a plurality of the segmented rings is adjacent a pair of the segmented rings, and wherein said each ring is both circumferentially displaced with respect to one of its adjacent rings and is counter-circumferentially displaced with respect to the other of its adjacent rings.

7. The magnetic roll of claim 6 wherein each circumferential or counter-circumferential displacement is at least as great as one-fourth of the circumferential length and is less than or equal to one-half of the circumferential length.

8. The magnetic roll of claim 7 wherein each segmented ring has an even number of segments.

9. The magnetic roll of claim 8 wherein the magnetic armature has a cylindrical outer surface.

10. The magnetic roll of claim 9 wherein the magnetic armature is composed of iron or steel.

11. The magnetic roll of claim 10 wherein the bonding matrix comprises hardened epoxy resin or a cyanoacryalate base adhesive.

12. The magnetic roll of claim 11 further comprising a rotation axle mounted inwardly from the magnetic armature's cylindrical outer surface.

13. The magnetic roll of claim 12 wherein each permanent magnet is composed of a material selected from the group consisting of a neodymium and iron composite, a samarium, cobalt, and iron composite, an aluminum, nickel, cobalt and iron alloy, and an iron oxide composite ceramic.

* * * * *